US005745918A

United States Patent [19]

Shukla et al.

[11] Patent Number: 5,745,918

[45] Date of Patent: May 5, 1998

[54] NECKTIE AS AN INFORMATION SOURCE

[76] Inventors: Mukta M. Shukla; Ashok K. Shukla, both of 10024 Century Dr., Ellicott City, Md. 21042

[21] Appl. No.: 853,478

[22] Filed: May 9, 1997

[51] Int. Cl.[6] ..... A41D 25/00; A41D 27/08

[52] U.S. Cl. ..... 2/144; 2/145; 2/244; 434/395; 434/400

[58] Field of Search ..... 2/144, 145, 146, 2/147, 148, 149, 150, 151, 152.1, 153, 154, 155, 156, 157, 115, 113, 105, 114, 106, 244, 243.1; 446/26, 27, 28; 40/586; 273/292, 299, 302, 303, 308, 148 R, 459; 434/81, 99, 347, 395, 400, 433

[56] References Cited

U.S. PATENT DOCUMENTS

| | | | |
|---|---|---|---|
| 854,284 | 5/1907 | Frost | 2/145 X |
| 1,125,793 | 1/1915 | Barnes | 2/145 X |
| 1,600,108 | 9/1926 | Gell . | |
| 1,745,946 | 2/1930 | Murray . | |
| 2,006,427 | 7/1935 | Wolfson | 2/145 |
| 4,505,497 | 3/1985 | Katzman | 283/81 |
| 5,180,306 | 1/1993 | McInroy et al. | 434/129 |
| 5,186,467 | 2/1993 | Chasin . | |
| 5,439,232 | 8/1995 | Pollock | 273/431 |
| 5,651,677 | 7/1997 | Hildebrandt | 2/145 X |

FOREIGN PATENT DOCUMENTS

| | | | |
|---|---|---|---|
| 579972 | 1/1994 | European Pat. Off. | 2/145 |

*Primary Examiner*—Jeanette E. Chapman

[57] ABSTRACT

This invention relates to the use of the conventional necktie as a source of information or for communicating a message in text and/or graphic, either by printing, painting, embroidering, or by thermal, chemical, and physical bonding to the surface of the necktie.

4 Claims, 4 Drawing Sheets

NECKTIE AS AN INFORMATION SOURCE

FIELD OF THE INVENTION

This invention relates to the use of the conventional necktie as a source of information or for communicating a message in text and/or graphic, either by printing, painting, embroidering, or by thermal, chemical and physical bonding to the surface of the necktie.

BACKGROUND OF INVENTION

Neckties are used in almost all cultures and societies. Here, we describe the application of the conventional necktie for communicating a message or information. The neckties come in different shapes and sizes and the back (the side facing towards the wearer) of the tie generally has a tag with the name and/or country of manufacture and/or designer's name. This area of the necktie facing towards the wearer can be used for printing or placing any information or message of any type; photo, text, graphic or art work. Such types of information can be valuable for conveying or communicating any message or fact.

In this invention, we describe the simple method of propagation of information using a conventional necktie, which can be valuable for advertisement or for conveying any information and/or knowledge and/or message. At the back of the necktie (the side facing towards the wearer) there is enough space either on the entire surface or the lower area of the wide end of the necktie, to place the information about the necktie or a description related to the picture/photo/graphic design or text printed on the front side of the necktie (the side facing away from the wearer).

SUMMARY OF THE INVENTION

It is an object of this invention to provide a necktie as a device for communicating a message, fact, information and/or knowledge.

It is a further object of this invention to provide a necktie as an information source and the said information can be in the form of either a text, numbers, photo or a graphic design or a combination of these.

It is a further object of this invention to provide a necktie as an information source and the said information can be painted, printed, embroidered or attached by chemical, thermal, physical (such as stitching, Velcro etc.) bonding to the surface of the necktie.

The various features of novelty which characterize the invention are pointed out with particularity in the claims annexed to and forming a part of this disclosure. For a better understanding of the invention, its advantages and objects, reference is made to the accompanying drawings and descriptive matter in which a preferred embodiment of the invention is illustrated.

BRIEF DESCRIPTION OF THE DRAWINGS

The foregoing and still other objects of this invention will become apparent, along with various advantages and features of novelty residing in the present embodiments from study of the following drawings, in which.

DESCRIPTION OF THE PREFERRED EMBODIMENT

Figure 1:
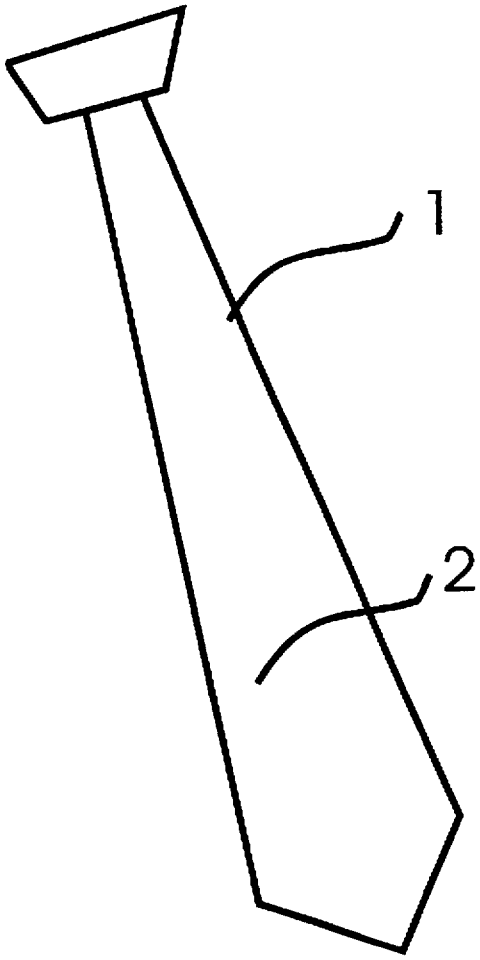
FIG. 1. is a view of the front (the side facing away from the wearer) of a necktie.
Figure 2:
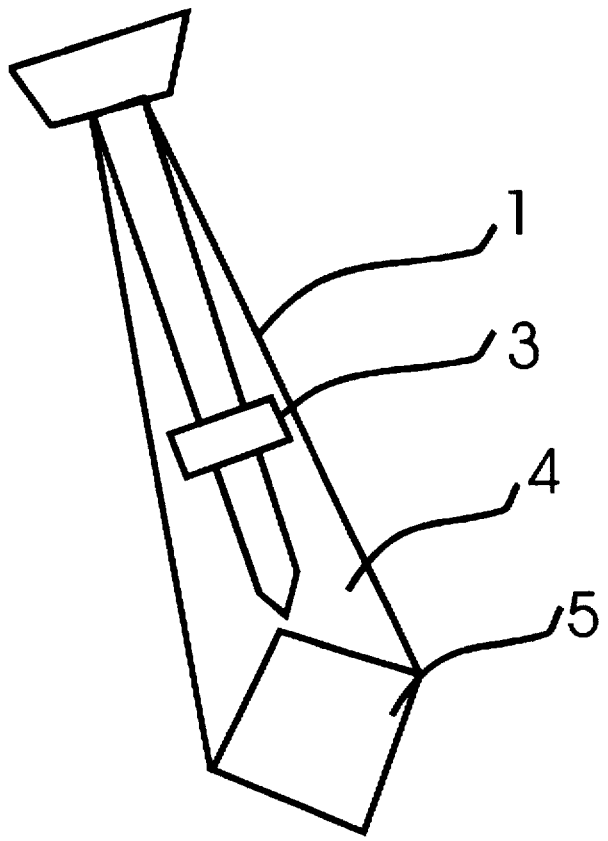
FIG. 2. is a view of the back (the side facing towards the wearer) of a necktie.
Figure 3:
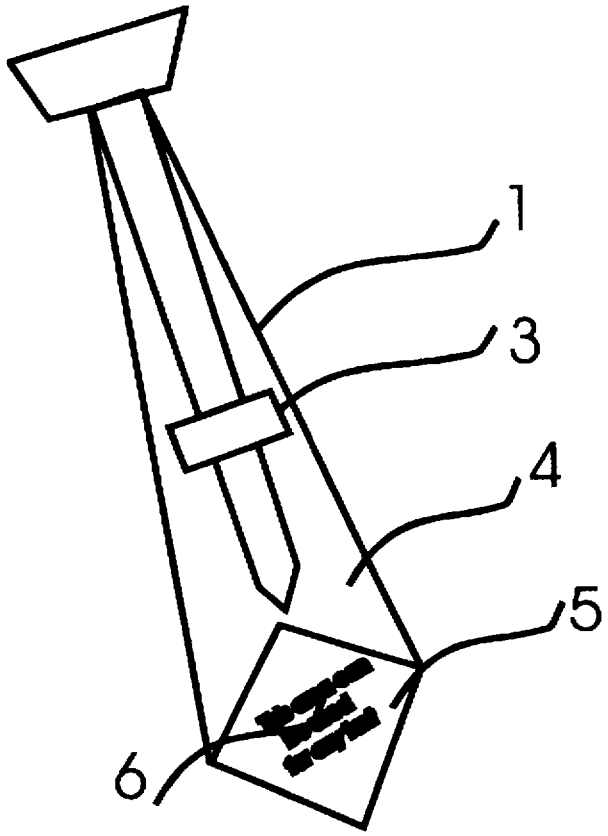
FIG. 3. is a view of the information block on the necktie in text form.
Figure 4:
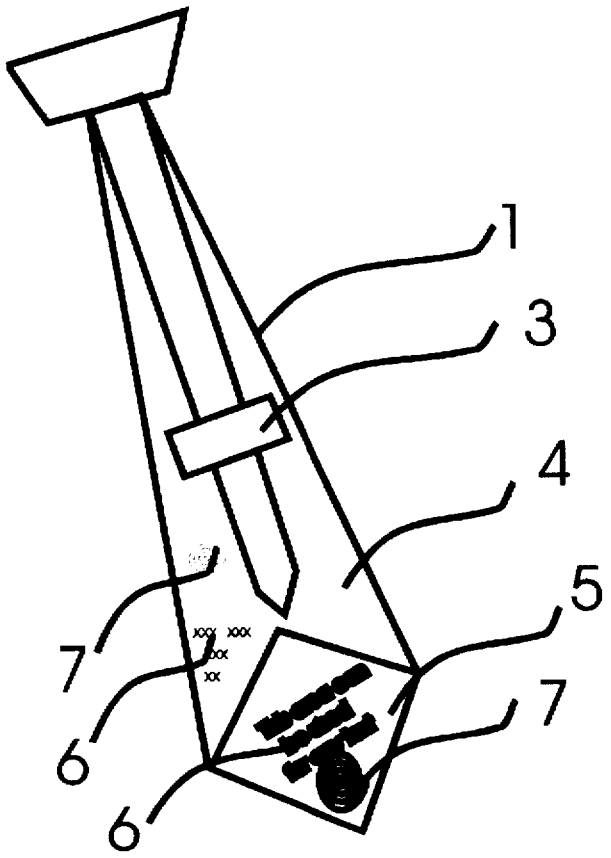
FIG. 4. shows the information block as a graphic design or photo with a text.

Referring to the drawings, FIG. 1 shows the conventional necktie (1) front (2) or the outward side (the side facing away from the wearer). This necktie can be of any shape or size and made of any material. FIG. 2 shows the back (the side facing towards the wearer) of the necktie (4) and the tag (3), which is generally used for the manufacturer or designer's name and address information. To our knowledge, a necktie that uses its entire back area (4) or the lower area of the wide end (5) for printing, weaving, screen printing, painting, embroidering or inserting any type of information in the graphic and/or text form, does not exist in the market. This back flap area (4) and (5) can be used for inserting any piece of information by printing, painting, embroidering, or by chemical, thermal or physical (stitching, Velcro etc.) bonding on the necktie surface area(4), FIG. 3. The information on this area can be of any type, either a text (FIG. 4) or a text (6) and graphic (7) or only graphic (7)(FIG. 4). The information in text and/or graphic form can be made of any material such as ink, thread, paint, metal, plastic, textile.

The broader usefulness of the invention may be illustrated by following examples.

EXAMPLE OF APPLICATIONS

Example #1

Display of information about a person

If a necktie used by Einstein is replicated, the necktie has to convey information associated with Einstein relating to a certain fact or event; for example the following text is printed on the back flap "This is a replica of the tie worn by the famous physicist Albert Einstein in the year 1921 during the Noble Prize ceremony, where he received the Nobel Prize for physics." This is a valuable information about the person and the significance of the necktie and also enhances learning and knowledge about a subject.

Example #2

Historical Information Display

The front of the necktie has a picture of the statue of liberty and the back of the necktie has information about the statue of liberty; its significance and importance and other historical information and facts as to how and why it became a symbol of the free world.

Example #3

Display of a famous painting and the painter

The front of the Necktie has the picture of a famous painting or painter and the back has information about the same, for example the artist, facts about him and what inspired him to paint the artwork pictured.

Example #4

Display of information about a certain significant event

The front of the necktie has a picture of Apollo 11, the first manned mission to the moon and says for example "Humankind's first steps on the Moon." The back of the tie contains information about the same, "In 1969, Neil Armstrong took the first manned mission to the Moon. His first words were: A small step for man, a giant leap for the mankind."

Example #5

To display information about a certain product or service

The front has a picture of a computer and the back has a description of the company, for example IBM.

Example #6

Display of information relating to an inspirational message or a famous quotation The front has a picture of a forest or "woods" and the back has Robert Frost's famous verse "Two roads diverged into the woods; I took the one less traveled by, and that has made all the difference."

Example #7

Display of a symbol on the front (2) side of the necktie and the back (4) side has a description or a message related to the symbol For example, the front has two doves as a symbol of peace and the back contains a message relating to the same picture by Gandhi or Mother Teresa.

While a specific embodiment of the invention has been shown and described in detail to illustrate the application of the principles of the invention, it is understood that the invention may be embodied otherwise without departing from such principles and that various modifications, alternate constructions, and equivalents will occur to those skilled in the area given the benefit of this disclosure and the embodiment described herein, as defined by the appended claims.

What is claimed is:

1. A necktie comprising a wide end and a narrow end and a knot portion therein between; said wide end having a front side that will face away from the wearer and said front side having a graphic design said wide end also having; a back side that will face towards the wearer and said back side at its wide lower end having text information permanently placed on said back side wide lower end; and said text information explains said graphic design of said front side.

2. A necktie comprising a wide end and a narrow end and a knot portion therein between; said wide end having a front side that will face away from the wearer and said front side having a graphic design; said wide end also having a back side that will face towards the wearer and said back side at its wide lower end having graphic information permanently placed on said back side wide lower end; and said graphic information explains said graphic design of said front side.

3. The necktie of claim 2; wherein said graphic information includes a photograph.

4. The necktie of claim 1 or claim 2, wherein said information is placed on said back side by a placing means and said information is in a form selected from the group consisting of printing, painting, weaving, screen printing, and embroidery.

* * * * *